US006315377B1

(12) United States Patent
Jeon

(10) Patent No.: US 6,315,377 B1
(45) Date of Patent: Nov. 13, 2001

(54) DEVICE AND METHOD FOR PROTECTING A RECORDING HEAD AND FOR REDUCING POWER CONSUMPTION IN INK JET RECORDING APPARATUS

(75) Inventor: Cheol-Min Jeon, Kyongsangbuk-do (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/201,154

(22) Filed: Nov. 30, 1998

(30) Foreign Application Priority Data

Nov. 29, 1997 (KR) ..... 97-64714

(51) Int. Cl.[7] ..... B41J 29/38
(52) U.S. Cl. ..... 347/9; 345/5; 345/14
(58) Field of Search ..... 347/14, 5, 9

(56) References Cited

U.S. PATENT DOCUMENTS

| | | | | |
|---|---|---|---|---|
| 5,526,027 | * | 6/1996 | Wade et al. | 347/14 |
| 5,604,597 | * | 2/1997 | Imai | 358/296 |
| 5,803,623 | * | 9/1998 | Iwasaki | 400/54 |
| 5,835,115 | | 11/1998 | Kitazawa | 347/57 |
| 5,844,813 | * | 12/1998 | Tateyama | 364/528.3 |

* cited by examiner

*Primary Examiner*—John Barlow
*Assistant Examiner*—Alfred Dudding
(74) *Attorney, Agent, or Firm*—Robert E. Bushnell, Esq.

(57) ABSTRACT

A device and method for protecting a recording head in an ink jet recording apparatus. If no print command is detected at an idle state in which a power source of the ink jet recording apparatus is turned on, a head driving voltage for driving the recording head is cut off. Moreover, if there is no print data upon receiving a print command, the head driving voltage is cut off.

9 Claims, 2 Drawing Sheets

DEVICE AND METHOD FOR PROTECTING A RECORDING HEAD AND FOR REDUCING POWER CONSUMPTION IN INK JET RECORDING APPARATUS

CLAIM OF PRIORITY

This application makes reference to, incorporates the same herein, and claims all benefits accruing under 35 U.S.C §119 from an application entitled Device And Method For Protecting Recording Head In Ink Jet Recording Apparatus earlier filed in the Korean Industrial Property Office Nov. 29, 1997, and there duly assigned Serial No. 97-64714 by that Office.

BACKGROUND OF THE INVENTION

1. Field of the Invention

The present invention relates to an ink jet recording apparatus such an ink jet facsimile or an ink jet printer, and more particularly, to a device and method for reducing power consumption and protecting an ink jet recording head in an ink jet recording apparatus.

2. Description of the Related Art

To record an image on a recording medium such as a recording sheet or a film, recording apparatuses of a wire dot type, a thermal transfer type and an ink jet type use an unique recording head. In these recording apparatuses, an ink jet recording apparatus records an image by ejecting ink onto a recording medium. An ink jet recording head used in the ink jet recording apparatus includes a plurality of nozzles each having a fine ejection hole for ejecting ink. Ink within the nozzles is heated by a heating element installed correspondingly at each nozzle and then expanded. The ink which has expanded is ejected to the exterior of the nozzles and fixed onto a recording medium. The ink jet recording apparatus selectively drives the nozzles of the recording head to record an image.

Typically the ink jet recording apparatus uses a driving voltage of 11.75V applied to a head driver and the recording head. Since the driving voltage of 11.75V continues to be supplied to the head driver and the recording head, power is consumed even at an idle state. Furthermore, if a user exchanges the recording head without turning off the ink jet recording apparatus, the recording head may be damaged due to the driving voltage of 11.75V and an electric short between recording head ports.

U.S. Pat. No. 5,835,115 to Hiroaki Kitazawa entitled Image Recording Method And Apparatus describes an ink jet printer having an image recording method and apparatus for performing stable image recording with a minimum power consumption according to a recording operation wherein ink is discharged onto a recording medium, the recording operation comprising: a power generation step of generating a power on the basis of image data, an accumulating step of accumulating the power generated in the power generation step, a heating step of supplying the accumulated power by the accumulating step to a heater to heat said heater according to the image data, and a discharging step of discharging said ink from a recording head onto said recording medium on the basis of a thermal energy from the heater heated in the heating step.

SUMMARY OF THE INVENTION

It is therefore an object of the present invention to provide a recording head protecting device and method which can reduce power consumption by cutting off a voltage supplied to an ink jet recording head when there is no print data at a print mode in an ink jet recording apparatus.

It is another object of the present invention to provide a recording head protecting device and method which can protect an ink jet recording head by cutting off a voltage supplied to the recording head while a user exchanges the recording head without turning off a power source in an ink jet recording apparatus.

According to one aspect of the present invention, a device for protecting a recording head in an ink jet recording apparatus includes: a power supply for generating a head driving voltage from an alternative current (AC) input power source; a central processing unit for receiving a print command from a personal computer or a facsimile, generating a head driving signal, generating a power-off control signal when there is no print command, or when no print data is detected even though there is a print command, and generating a power-on control signal when there is a print command and when print data is detected; a driving voltage controller for switching on or off the head driving voltage supplied from the power supply by the power-on or power-off control signal supplied from the central processing unit; and a head driver for receiving the head driving voltage from the driving voltage controller and heating nozzles contained in the recording head by the head driving signal generated from the central processing unit.

According to another aspect of the present invention, a method for protecting a recording head in an ink jet recording apparatus includes the steps of: checking whether a print command is received at an idle state in which a power source of the ink jet recording apparatus is turned on; and if no print command is detected, cutting off a head driving voltage for driving the recording head.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

Figure 1:
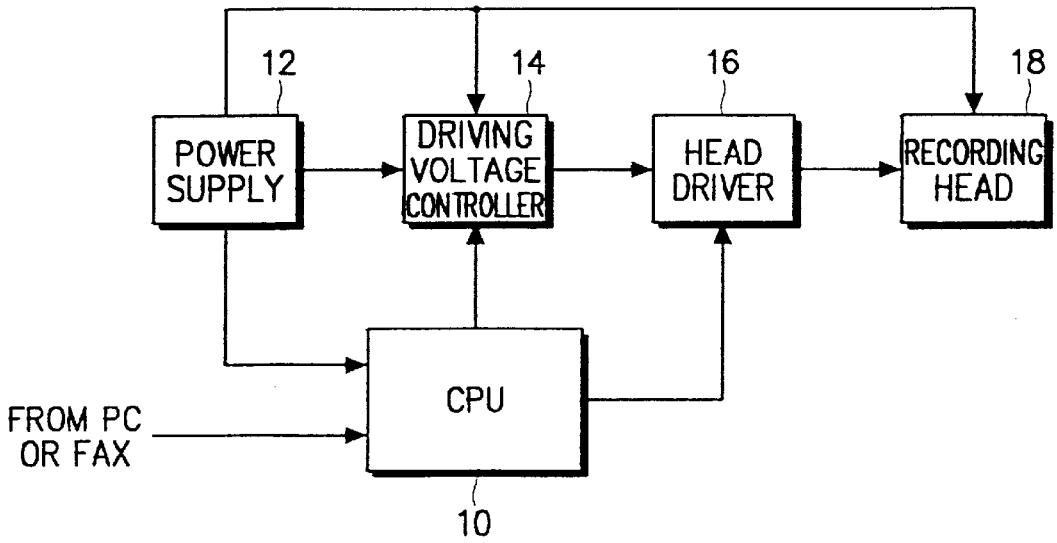
FIG. 1 is a block diagram of a recording head protecting device of an ink jet recording apparatus according to a preferred embodiment of the present invention.

Referring to FIG. 1, a central processing unit (CPU) 10 receives a print command from a personal computer (PC) or a facsimile (FAX) and generates a head driving signal and power-on or power-off control signal. If there is no print command, or if no print data is detected even though there is a print command, the CPU 10 generates the power-off control signal. A power supply 12 generates a head driving voltage from an alternative current (AC) input power source and generates first and second power voltages Vcc1 and Vcc2 each having a different voltage level. The first power voltage Vcc1 for operating logic circuits is typically 5V and is supplied to the CPU 10 and a driving voltage controller 14. The second power voltage Vcc2 for operating a recording head 18 and a mechanical driver (not shown) is used as a driving power voltage of 24V. The driving voltage controller 14 switches on or off the head driving voltage supplied from the power supply 12 by the power-on or power-off control signal supplied from the CPU 10. A head driver 16 receives the head driving voltage from the driving voltage controller 14 and heats nozzles contained in the recording head 18 in response to the head driving signal generated from the CPU 10. The recording head 18 ejects ink in the nozzles to record data onto a recording medium.

Figure 2:
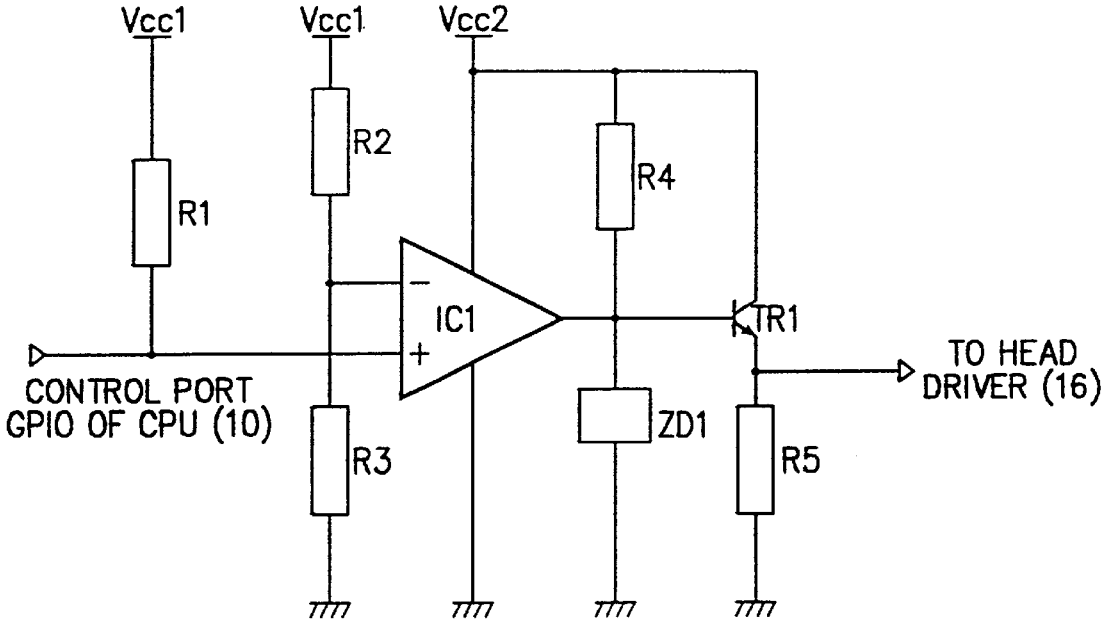
FIG. 2 is a more detailed circuit diagram of a driving voltage controller shown in FIG. 1.

FIG. 2 is a more detailed circuit diagram of the driving voltage controller 14 shown in FIG. 1. A pull-up resistor R1 is connected between a first power voltage Vcc1 terminal of the power supply 12 and a driving voltage control port GPIO of the CPU 10. Resistors R2 and R3 connected serially between the first power voltage Vcc1 terminal and a ground terminal constitute a reference voltage generator and generate a reference voltage. A comparator IC1 has a non-inverting terminal (+) connected to the driving voltage control port GPIO of the CPU 10 and has an inverting terminal (−) connected to a terminal to which the reference voltage is output by the resistors R2 and R3. The comparator IC1 compares the power-on or power-off control signal generated from the CPU 10 with the reference voltage and generates a power path switching control signal for switching a power supply path. A transistor TR1 switches on or off a voltage for driving the recording head 18 by the power path switching control signal generated from the comparator IC1. A Zener diode ZD1 is connected between an output terminal of the comparator IC1 and the ground terminal and passes a voltage having a prescribed level or more so as to determine a given bias voltage for operating the transistor TR1. A load resistor R4 for supplying the bias voltage of the transistor TR1 at a stabilized level is connected between a second power voltage Vcc2 terminal and the Zener diode ZD1. A load resistor R5 for generating the head driving voltage at a stabilized level is connected between an emitter of the transistor TR1 and the ground terminal.

Figure 3:
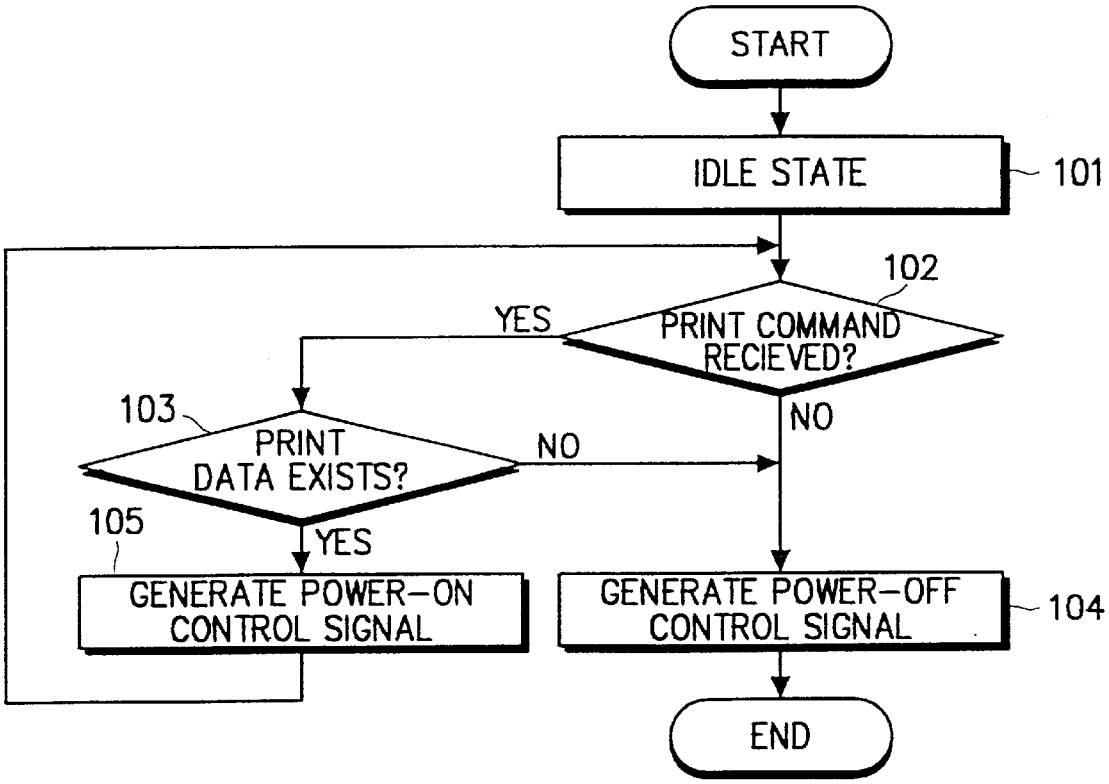
FIG. 3 is a flow chart for controlling a head driving voltage in response to a print command according to a preferred embodiment of the present invention.

FIG. 3 is a flow chart for controlling a head driving voltage in response to a print command according to a preferred embodiment of the present invention. If the user turns on a power source of an ink jet recording apparatus, the CPU 10 is maintained at an idle state at step 101. At step 102, it is checked whether a print command is received from a personal computer or a facsimile. If the print command is received, whether there is print data is checked at step 103. If no print command is detected at step 102, or if there is no print data at step 103, the CPU 10 generates the power-off control signal at step 104. That is, the CPU 10 supplies a logic "low" signal through the driving voltage control port GPIO to the driving voltage controller 14. The logic "low" signal generated through the driving voltage control port GPIO is supplied to the non-inverting terminal (+) of the comparator IC1. The comparator IC1 compares the logic "low" signal with the reference voltage generated by the resistors R2 and R3 and generates the logic "low" signal. Therefore, the transistor Tr1 is turned off and the head driving voltage is not supplied to the head driver 16. As a result, if there is no print data even at a print mode, the head driver 16 is not driven, thereby reducing power consumption. Moreover, the head driving voltage is not supplied to the recording head 18 while the recording head 18 is exchanged. Therefore, each recording head port is prevented from being shorted and the recording head 18 can be protected.

If there is print data at step 103, the CPU 10 generates the power-on control signal at step 105. Namely, the CPU 10 supplies a logic "high" signal through the driving voltage control port GPIO to the driving voltage controller 14. The logic "high" signal is supplied to the non-inverting terminal (+) of the comparator IC1. The comparator IC1 compares the logic "high" signal with the reference voltage and generates the logic "high" sig al. Therefore, the transistor TR1 is turned on and the head driving voltage is supplied to the head driver 16 so as to record data.

As described above, if the ink jet recording apparatus is at an idle state or if there is no data to be printed at a print mode, the head driving voltage for driving the recording head is cut off, thereby reducing power consumption. Moreover, even if the user exchanges the recording head at an idle state in which the power source of the ink jet recording apparatus is turned on, the recording head can be protected from being damaging.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A device for protecting a recording head and reducing power consumption in an ink jet recording apparatus, comprising:

a power supply for generating a head driving voltage from an alternating current input power source;

a central processing unit for receiving a print command, generating a head driving signal and generating a power control signal;

a head driver for receiving said head driving voltage and for heating nozzles contained in said recording head in response to said head driving voltage and said head driving signal; and a driving voltage controller for switching on or off said head driving voltage supplied from said power supply to said head driver in response to said power control signal supplied from said central processing unit, characterized in that said power control signal is a power-off control signal when no print data is detected even though there is a print command, and said power control signal is a power-on control signal when there is a print command and when print data is detected.

2. The device as set forth in claim 1, further characterized in that said power control signal is a power-off control signal when there is no print command.

3. A device for protecting a recording head and reducing power consumption in an ink jet recording apparatus, having a power supply for generating a head driving voltage from an alternating current input power source, a central processing unit for receiving a print command, generating a head driving signal and generating a power control signal, and a head driver for receiving said head driving voltage and for heating nozzles contained in said recording head in response to said head driving voltage and said head driving signal, said device comprising:

a driving voltage controller for switching on or off said head driving voltage supplied from said power supply to said head driver in response to said power control signal supplied from said central processing unit, characterized in that said power control signal is a power-off control signal when there is no print command or when no print data is detected even though there is a print command, and said power control signal is a power-on control signal when there is a print command and when print data is detected, wherein said driving voltage controller comprises:

a reference voltage generator for receiving a prescribed voltage from said power supply and generating a reference voltage;

a comparator for generating a switching control signal as a result of comparing said power control signal with said reference voltage, said comparator having a non-inverting terminal connected to a driving voltage control port of said central processing unit for receiving said power control signal and having an inverting terminal connected to said reference voltage generator for receiving said reference voltage; and a switching circuit for switching on or off said head driving voltage in response to said switching control signal generated from said comparator.

4. The device as set forth in claim 3, wherein said reference voltage generator comprises a pair of resistors connected in series between a ground terminal and a first power voltage for operating logic circuits output from said power supply, a connecting node connecting said resistors in series being connected to said inverting terminal of said comparator.

5. The device as set forth in claim 3, further comprising a resistor connected between said non-inverting terminal of said comparator and a first power voltage for operating logic circuits output from said power supply.

6. The device as set forth in claim 3, wherein said switching circuit comprises a transistor having a base connected to an output terminal of said comparator to receive said switching control signal.

7. The device as set forth in claim 6, wherein said switching circuit further comprises:

a Zener diode connected between said output terminal of said comparator and a ground terminal;

a first load resistor being commonly connected at one end to said Zener diode and said output terminal of said comparator, said first load resistor being commonly connected at another end to a power voltage terminal of said power supply and a collector of said transistor, said power voltage terminal outputting said head driving voltage; and a second load resistor connected between an emitter of said transistor and said ground terminal.

8. A method for protecting a recording head and reducing power consumption in an ink jet recording apparatus, comprising steps of:

checking whether a print command is received during an idle state in which a power source of said ink jet recording apparatus is turned on;

checking for print data, when said print command is received;

cutting off a head driving voltage for driving said recording head, when it is determined that there is no print data and said print command is received; and cutting off said head driving voltage for driving said recording head, when no print command is detected.

9. The method as claimed in claim 7, further comprising a step of supplying said head driving voltage for driving said recording head, when it is determined that there is print data and a print command.

* * * * *